United States Patent [19]

Nguyen et al.

[11] Patent Number: 4,465,561

[45] Date of Patent: Aug. 14, 1984

[54] ELECTROPLATING FILM-FORMING METALS IN NON-AQUEOUS ELECTROLYTE

[75] Inventors: Thinh Nguyen, Onex, Switzerland; Jean-Marie Fresnel, St. Genis, France; Henri B. Beer, Heide-Kalmthout, Belgium

[73] Assignee: Diamond Shamrock Chemicals Company, Dallas, Tex.

[21] Appl. No.: 467,153

[22] Filed: Feb. 16, 1983

[30] Foreign Application Priority Data

Feb. 18, 1982 [EP] European Pat. ..... 82810075

[51] Int. Cl.[3] ..... C25D 3/44; C25D 5/30; C25D 5/44; C25F 3/04

[52] U.S. Cl. ..... 204/58.5; 204/33; 204/141.5

[58] Field of Search ..... 204/33, 42, 14 N, 141.5

[56] References Cited

U.S. PATENT DOCUMENTS 2,791,553 5/1957 Conner ..... 204/141.5
2,873,233 2/1959 Schnable ..... 204/32 R
2,966,448 12/1960 Conner ..... 204/33
4,126,523 11/1978 Wong ..... 204/141.5
4,388,159 6/1983 Dockus ..... 204/33

*Primary Examiner*—Thomas Tufariello
*Attorney, Agent, or Firm*—Bruce E. Harang; John J. Freer

[57] ABSTRACT

Metals such as lead, silver, copper, calcium, antimony, cadmium, nickel and zinc are electroplated onto a film-forming metal substrate from the group of aluminium, titanium, zirconium, niobium, molybdenum, tungsten, tantalum and alloys thereof, using an etching/electroplating solution comprising ions of the metal(s) to be plated, optionally alkali metal ions, aluminium halide and an aromatic hydrocarbon. Surface oxide is removed from the film-forming metal substrate by reaction with the aluminium halide and the metal(s) in solution to form soluble complexes, this possibly being assisted by anodization. This is followed by cathodically connecting the substrate and passing current to electroplate the metal(s) onto the oxide-free surface, directly in the same etching/electroplating solution.

7 Claims, No Drawings

ELECTROPLATING FILM-FORMING METALS IN NON-AQUEOUS ELECTROLYTE

TECHNICAL FIELD

The invention relates to methods of electroplating metals such as lead, silver, copper, calcium, antimony, tin, cadmium, nickel and zinc and alloys of these metals onto a substrate of a film-forming metal from the group of aluminium, titanium, zirconium, niobium, molybdenum, tungsten, tantalum and alloys thereof in non-aqueous electrolyte.

BACKGROUND ART

Present methods of electroplating the above metals directly onto film-forming substrates involve removing oxide skin from the substrate in a first etching bath, then transferring the substrate to a plating bath. This usually also involves pre-plating the substrate. For example, aluminium must be pre-plated with zinc or tin covered with copper before an adherent layer of lead can be electroplated.

DISCLOSURE OF INVENTION

The invention consists of placing the film-forming metal substrate in an etching/electroplating solution comprising ions of the metal(s) to be plated (and optionally alkali metal ions), aluminium halide and an aromatic hydrocarbon; removing surface oxide from the film-forming metal substrate by reaction with the aluminium halide and the metal(s) in solution to form soluble complexes; followed by cathodically connecting the substrate and passing electrolysis current to the electroplate the metal(s) onto the oxide-free surface. Removal of the surface oxide film is preferably assisted by anodising the substrate.

In this novel method, etching of the aluminium or other valve metal substrate and subsequent electroplating with a metal such as lead or a lead alloy is thus carried out in a single bath of suitable composition, instead of the conventional process in which the aluminium or other substrate is etched in a first bath and then transferred to a separate plating bath.

In effect, an oxide-free surface of aluminium or other film-forming substrate can be obtained by etching in a solution of an aluminium halide ($AlX_3$) and an aromatic hydrocarbon (ah), the $Al_2O_3$ film being dissolved in this medium by formation of soluble oxy-halide complexes with $AlX_3$. This etching step can be accelerated by anodization of the aluminium substrate. A very clean surface of aluminium can be obtained rapidly by this method if the $AlX_3$-ah solution contains a certain quantity of alkali and/or metallic halides. The presence of a minimum quantity of alkali and/or metallic halides is necessary to dissolve the $AlX_3$ formed by anodization of the Al substrate, by the formation of $[Mn+.nAlX_4-]$ or $[Mn+.nAl_2X_7-]$ complexes which are more soluble than $AlX_3$ in ah.

By using an appropriate metallic halide $MX_n$ as the complexing agent in solution, the electrodeposition of M can be obtained directly onto the aluminium substrate by a subsequent cathodic polarization in the same solution. The surface treatment of the aluminium substrate is preferably carried out with an acidic composition of the bath, because the dissolution of the aluminium oxide film is only possible in the presence of $Al_2X_6$ or $Al_2X_7$-forms. Consequently, this process applies mainly to metals which are deposited at a potential more positive than aluminium and, because of the potential levelling effect of $AlX_3$-ah medium, an alloy deposit can be obtained by using a mixture of metallic haldies. In particular the process applies to the electrodeposition of lead and alloys such as Pb-Ag, Pb-Ca, Pb-Sb.

A very adherent Pb deposit may be obtained directly onto an Al substrate from a solution of $AlCl_3$-$PbCl_2$-LiCl in toluene. $AlCl_3$ is preferable to $AlBr_3$ or $AlCl_3$ because of its stronger affinity to form the oxyhalide complexes. $AlF_3$ is not soluble in ah. Toluene is the preferred ah solvent because its basicity is weak enough not to decrease the etching power of $AlCl_3$. Benzene can also be used but the solubility of $AlCl_3$ in toluene is higher than in benzene, and the latter is more toxic.

The bath conductivity increases with the concentration of $AlCl_3$ and the $AlCl_3$: toluene molar ratio is preferably between 0.20 and 0.40, the optimum $AlCl_3$:toluene molar ratio being 0.33. The concentration of $PbCl_2$ and LiCl depends on the total quantity of $AlCl_3$ in solution. The total molar ratio $[PbCl_2+LiCl]:AlCl_3$ should be lower than 0.40 and higher than 0.20. The $LiCl:AlCl_3$ molar ratio is preferably between 0 and 0.30; the bath conductivity increases with the concentration of LiCl and the preferred $LiCl:AlCl_3$ molar ratio is therefore near the maximum value 0.30. With this maximum concentration of LiCl, the $PbCl_2:AlCl_3$ molar ratio should be lower than 0.10 and higher than 0.05. The concentration of chloride compounds of an optional alloying element (Ag, Ca) is generally fixed at about 1 mole % of that of $PbCl_2$. Excellent results have been obtained in the above indicated concentration ranges which are given for guidance and are not intend to define operating limits.

The process is conducted in an inert atmosphere such as nitrogen with an allowable $O_2$ and $H_2O$ content of about 0.5%.

The bath temperature is maintained at 25° to 65° C. The solubility of solutes increases with the temperature, but an operating temperature range of 35° to 45° C. is preferred to avoid solvent loss by evaporation.

The aluminium substrate is cleaned first by sandblasting or by alkali etching in order to remove the major part of the natural oxide film, and afterwards degreased in hot acetone, possibly with ultrasound. Pure aluminium or commercial alloys ("Anticorrodal") can be used as substrate.

The aluminium substrate is introduced into a bath with for example two Pb counter electrodes. The anodization step is made at a current density of 3 to 10 $mA/cm^2$. After the anodization step, the substrate is allowed to stand in solution during 2 to 15 minutes, with strong stirring in order to completely remove the traces of aluminium compounds formed by anodization. Afterwards, the substrate is polarized cathodically with a plating current density of 5 to 50 $mA/cm^2$. The optimum plating current density is 20 to 25 $mA/cm^2$. Adherent, impermeable Pb deposits, with a thickness of 50 to 150 micron, are obtained with a current efficiency of 75 to 100%.

Similar conditions are used for coating aluminium particles, but in this case the sandblasting step is replaced by an etching in NaOH 5% at 60° C.

Broadly, the novel electroplating method applies to the other mentioned substrates with film-forming properties. Metals other than lead and various alloys can be electroplated. The method thus applies to the electroplating of metals such as lead, silver, copper, calcium, antimony, tin, cadmium, nickel and zinc and alloys of these metals onto a substrate of a film-forming metal from the group of aluminium, titanium, zirconium, niobium, molybdenum, tungsten, tantalum and alloys thereof.

The invention is also useful in the bonding of metals one of which is a film-forming metal, this method consisting of first electroplating one of the aforementioned metals onto a substrate of the film-forming metal by the previously-described non-aqueous plating method in a single bath, and then bonding another metal to the electroplated metal. Often the bonded metal will be the same as the electroplated metal, such as lead on lead or copper on copper. The method of bonding may depend on the configuration, but generally any conventional method can be used, such as cladding by the application of heat and pressure, or casting.

One application of the invention is in the production of composite aluminium/lead or lead alloy electrodes in which the aluminium substrate is electroplated with lead or a lead alloy by the method of the invention, and then a sheet of lead or lead alloy is clad on top. Advantageously, an electrocatalyst can be incorporated in the clad lead layer. Such electrodes are further described in concurrently-filed application Ser. No. 467,088, C. J. Vance et al.

Another application of the invention is in the production of composite current-feeders e.g. copper-cored titanium or other film-forming metal tubes, used to carry current to dimensionally stable metal electrodes; in this case, an adherent copper layer can be electroplated in a titanium tube, then the tube is filled with copper.

This invention will be further illustrated in the following Examples.

EXAMPLE 1

A solution of $PbCl_2$:$AlCl_3$:toluene (molar ratio 0.066:0.33:1.0) is prepared from commercial products (Fluka, puriss quality). A pure Al (99.9%) substrate of dimensions $2.5\times6.5\times0.1$ cm was cleaned by sandblasting, and degreased in hot acetone with ultrasound during 10 minutes. Electrolysis was then carried out in a cylindrical glass cell, with magnetic strirring. The cell was placed in a glove box with a nitrogen atmosphere. Two Pb counter electrodes were used, the inter-electrode distance being 2.0 cm, and the toal immersed surface of the Al substrate 25 $cm^2$. The bath temperature was maintained at 40°-50° C.

The Al substrate was first polarized anodically at 10 $mA/cm^2$, the cell voltage being 6-7 volts. After passage of 200 Amp-seconds (8 Amp-sec/$cm^2$), the substrate was allowed to stand in the solution during 15 minutes. The deposition step was then made at 25 $mA/cm^2$, with a cell voltage of 8-9 volts. After passage of 2000 Amp-sec. (80 Amp-sec/$cm^2$), 1.82 g of Pb deposit was obtained. The average deposit thickness was 55-60 micron. The current efficiency was 85%.

The purity and impermeability of the Pb deposit were demonstrated by submitting the Pb coated Al electrode to voltammetry in HCl 5% at 20° C., and comparison with a pure Pb electrode. The adherence of the deposit was tested by bending the sample to more than 90°, the Al substrate breaking without peeling of the Pb layer.

EXAMPLE 2

A quantity of solid AgCl corresponding to 1 mole % of $PbCl_2$ was added to the preceding electrolyte. The electrolysis was made in the same conditions as Example 1 and a Pb-Ag alloy deposit was obtained.

The same electrolysis was then repeated, but with the AgCl additive replaced by $CaCl_2$. A Pb-Ca alloy deposit was obtained.

The following deposit compositions were obtained by X-ray diffraction analysis:

| Alloying element | Deposit surface composition |
|---|---|
| AgCl | Ag 1% - $PbO_2$ (<<1%) - Pb balance |
| $CaCl_2$ | Ca 1% - CaO (1%) - Pb balance |

The oxygen evolution potential of the Pb-Ag/Al electrode in sulphuric acid zinc electrowinning solution is 1.255 V vs. $Hg/HgSO_4$ at a current density of 400 $A/m^2$. This value is comparable with that of a bulk electrode of Pb-0.5% Ag.

EXAMPLE 3

A solution of $PbCl_2$:LiCl:$AlCl_3$:toluene (molar ratio 0.033:0.10:0.33:1.0) was prepared as above.

A commercial Al alloy substrate ("Anticorrodal") of dimensions $14.0\times40.0\times0.4$ cm was cleaned and degreased as above. The electrolysis was conducted in a rectangular polypropylene cell with two Pb counter electrodes. Electrolyte circulation was insured by pumping at a rate of about 12 l/min. Anodization was carried out at 4 $mA/cm^2$ with a charge of 10 Amp-sec/$cm^2$. After a 15 minute rest period, a Pb deposit of 70 micron was obtained with a charge of 100 Amp-sec/$cm^2$ at 15 $mA/cm^2$.

Two Pb foils 1 mm thick were then clad onto the two Pb precoated sides of the Al substrate. The bonding can be achieved by rolling under usual conditions, for example at 150°-170° C. under a pressure of 250-500 $Kg/cm^2$, after first removing the lead oxide skin from the lead surfaces using an etching agent such as concentrated acetic acid. The deformation of the Pb foils is up to about 20%; no deformation of the substrate was observed.

The apparent density of this composite Pb-Al-Pb (1 mm-4 mm-1 mm) structure is 5.6 $g/cm^3$, compared to 11.39 $g/cm^3$ for lead and 2.7 $g/cm^3$ for "Anticorrodal" aluminium. Its electrical resistivity was $6.7\times10^{-6}$ ohm cm in the length direction, and $10.3\times10^{-6}$ ohm cm in the thickness direction, compared to $22.8\times10^{-6}$ ohm cm for lead and $5.1\times10^{-6}$ ohm cm for "Anticorrodal" aluminium. These measurements demonstrate that there is no contact resistance between the lead and aluminium.

A charge of 0.05 $g/cm^2$ of activated Ti particles of −28 mesh (600 micron) was pressed onto the surfaces of the composite Pb-Al-Pb structure. A good penetration of the Ti particles onto the Pb layers was obtained at 500 $kg/cm^2$ at ambient temperature. The deformation of the Pb layers due to this pressing step was less than 10%.

EXAMPLE 4

Titanium sponge with a particle size of 315-630 micron and activated with a ruthenium-manganese dioxide coating was pressed onto the two faces of a composite electroplated/clad Pb-Al-Pb structure prepared as in Example 3. The application pressure was 440 kg/cm$^2$ and the sponge loading was 380 g/m$^2$.

The activated composite anode was then tested in a zinc electrowinning solution containing 170 g/l $H_2SO_4$, 50 g/l Zn, 4 g/l Mn and the usual trace elements. At a current density of 400 A/m$^2$ the composite anode had an oxygen evolution potential of 1520 mV (vs. NHE) compared to 2100 mV for a bulk lead anode and 1950 mV for a bulk Pg/Ag 0.75% anode. After 3 days continuous operation, the composite anode displayed no sign of corrosion of the lead or the aluminium substrate, and was operating at a steady potential of 1730 mV (which is excellent in this solution).

EXAMPLE 5

A charge of 33 g of Al particles (99% purity) of dimensions 1 mm diameter and 20–30 mm length was etched in NaOH 5% at 60° C. for 5 minutes, rinsed first in water, then with acetone and dried in a nitrogen flow. The particles were then placed in a glass cell containing the same electrolyte as in Example 3. A titanium disc placed at the bottom of the cell served as the cathodic current feeder. A lead counter electrode was placed horizontally at a distance of 3 cm from the Al particle mass. The particles were agitated by a magnetic stirrer.

After an anodisation step at 0.3 Amp (9 Amp/kg particles) with a charge of 540 Amp-sec ($16\times10^3$ Amp-sec/kg particles), the Al particles were allowed to stand in the electrolyte for 15 minutes, with agitation. The subsequent lead deposition step was carried put at 1.5 Amp (45 Amp/kg particles) with a charge of $22\times10^3$ Amp-sec ($61\times10^4$ Amp-sec/kg particles); 26.25 g of Pb deposit was obtained on the surface of the Al particles. The apparent current efficiency was about 112%, and can be explained by the cementation of lead onto the active surfaces of the Al particles during the rest period.

The average thickness of the lead deposit, examined under microscope, was about 40–50 micron; the maximum thickness was about 100 micron and the minimum value was 20 micron.

The Pb coated Al particles were etched in 1 M acetic acid solution, washed with water, rinsed with acetone and dried in nitrogen flow.

A charge of 12 g of the Pb coated Al particles was pressed in a mould of 2.5 cm diameter of 250 kg/cm$^2$ and 170° C. A rigid structure of 2.5 cm diameter and 0.8 cm thickness was obtained. The apparent density was 3.04 g/cm$^3$. The apparent porosity was estimated at about 10%, the pores being confined to the surface layer. Inside the structure, the Pb-Pb bonding was very good and the compactness was practically 100%. The electrical resistivity in the thickness direction was $6.7\times10^{-6}$ ohm cm.

A charge of 12 g of the Pb coated Al particles was pressed between two Pb discs of 1 mm thickness under the same conditions as above. A rigid structure of 2.5 cm diameter and 1.0 cm thickness was obtained. The apparent density was 4.83 g/cm$^3$, and the apparent porosity was estimated at about 7%. The electrical resistivity in the thickness direction was $15\times10^{-6}$ ohm cm.

The corrosion resistance of the pressed structure of Pb coated Al particles was tested in $H_2SO_4$ solution (150 g/l), at an anodic current density of 400 A/m$^2$. After one week, the weight loss was less than 3 mg/cm$^2$ or less than 3 micron/day. A decrease of the corrosion rate with time was observed.

The self protecting character of the Pb-coated Al particle electrodes was demonstrated by the corrosion test of a structure having a pin hole made by a drill of 2 mm diameter. After one week, under the same test conditions as above, the dissolution of Al was only observed for 6 particles which were initially damaged.

EXAMPLE 6

A solution of $PbCl_2$:LiCl:$AlCl_3$:p-xylene (molar ratio 0.0165:0.20:0.33:1.00) was prepared.

A commercial Ti substrate of dimensions $2.5\times6.5\times0.1$ cm was cleaned and degreased as in Example 1. The electrolysis was conducted under similar conditions to Example 1. The anodisation step was carried out at 2 mA/cm$^2$; after a few minutes the electrolyte became dark brown due to the presence of the dissolved Ti species in solution. The subsequent deposition step was carried out immediately after the anodisation step, without any rest period. The initial current density was 2.5 mA/cm$^2$, and after 10 minutes was increased to 15 mA/cm$^2$. After passage of 625 Amp-sec (25 Amp-sec/cm$^2$), a smooth Pb deposit of about 20 micron was obtained. The adherence of the deposit was tested, with success, by bending tests.

EXAMPLE 7

A solution of CuCl:LiCl:$AlCl_3$:Toluene (molar ratio 0.033:0.10:0.33:1.00) was prepared as in Example 1. A pure Al (99.9%) substrate of dimensions $2.5\times6.5\times0.1$ cm was cleaned as in Example 1. The electrolysis was carried out under similar conditions to Example 1 except that two copper counter electrodes were used and the subsequent copper deposition step was made at 15 mA/cm$^2$. After passage of a cathodic charge of 625 mA-sec (25 Amp-sec/cm$^2$) a smooth, pure copper coating of about 20 micron thickness was obtained. The adherence of the deposit was tested, with success, by bending tests.

The same electrolyte was prepared, but CuCl was replaced by the same molar quantity of $NiCl_2$. The electrolysis was then repeated under the same conditions with two nickel counter electrodes. A smooth and adherent nickel depósit was obtained onto an Al substrate.

EXAMPLE 8

The same electrolyte as in Example 7 was used for copper and nickel deposition onto tantalum and zirconium substrates. The substrates were cleaned as above. The anodisation step was made at 2mA/cm$^2$, and the subsequent deposition step was carried out at 15 mA/cm$^2$. Smooth and adherent deposits of Cu and Ni were obtained respectively onto Ta and Zr substrates.

EXAMPLE 9

A solution of CuCl:LiCl:$AlCl_3$:p-xylene (molar ratio 0.0136:0.132:0.33:1.00) was prepared. A commercial Ti substrate was prepared as above. The electrolysis was conducted under the same conditions as above. An adherent and smooth deposit of Cu was obtained after passage of a cathodic charge of 625 Amp-sec.

We claim:

1. A method of electroplating metals such as lead, silver, copper, calcium, antimony, tin, cadmium, nickel and zinc and alloys of these metals onto a substrate of a film-forming metal from the group of aluminum, titanium, zirconium, niobium, molybdenum, tungsten, tantalum and alloys thereof, which consists of placing the substrate in an etching plus electroplating solution comprising ions of the metal(s) to be plated, aluminum halide and an aromatic hydrocarbon; removing surface oxide from the film-forming metal substrate in said etching plus electroplating solution by reaction with the aluminum halide and the metal(s) in solution to form soluble complexes; followed by cathodically connecting the substrate and passing electrolysis current to electroplate the metal(s) in said etching plus electroplating solution onto the oxide-free surface.

2. The method of claim 1, wherein removal of the surface oxide film is assisted by rendering the substrate anodic.

3. The method of claim 2, wherein the substrate is allowed to stand in the solution for a rest period after being polarized anodically and prior to electrodepositing the metal.

4. The method of claim 1, wherein the solution further comprises alkali metal ions.

5. The method of claim 1, wherein the substrate is aluminium and the plated metal is lead or a lead alloy.

6. In a method of bonding metals one of which is a film forming metal from the group of aluminium, titanium, zirconium, niobium, molybdenum, tungsten, tantalum and alloys thereof, the step of electroplating a metal such as lead, silver, copper, calcium, antimony, tin cadmium, nickel, zinc and alloys thereof onto a substrate of the film-forming metal by the method of claim 1, prior to bonding another metal to the electroplated metal.

7. The method of claim 6, wherein the electroplated metal is the same as the metal which is bonded thereto.

* * * * *